US006269751B1

(12) United States Patent
Hauck et al.

(10) Patent No.: US 6,269,751 B1
(45) Date of Patent: Aug. 7, 2001

(54) LENGTH-VARIABLE SLIDING RAIL ELEMENT FOR A ROLLER CHAIN

(75) Inventors: Julius Adolf Josef Hauck, Rottendorf; Erwin Paul Josef Lehrieder, Gaukönigshofen, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/403,751

(22) PCT Filed: Apr. 18, 1998

(86) PCT No.: PCT/DE98/01080

§ 371 Date: Oct. 29, 1999

§ 102(e) Date: Oct. 29, 1999

(87) PCT Pub. No.: WO98/50234

PCT Pub. Date: Nov. 12, 1998

(30) Foreign Application Priority Data

May 2, 1997 (DE) ..... 197 18 548

(51) Int. Cl.[7] ..... E01B 25/22

(52) U.S. Cl. ..... 104/106; 104/93; 101/228; 198/836.1; 198/836.3; 198/838

(58) Field of Search ..... 198/494, 836.3, 198/836.1, 626.1, 834, 838, 845, 823, 840, 842, 849; 104/103, 106, 107, 111, 172.4, 93, 94, 96; 101/225, 226, 227, 228

(56) References Cited

U.S. PATENT DOCUMENTS

| | | | | |
|---|---|---|---|---|
| 4,144,965 | * | 3/1979 | Alldredge et al. | 198/831 |
| 4,819,557 | * | 4/1989 | Handschuher | 101/228 |
| 4,967,669 | * | 11/1990 | Kuchta | 104/106 |
| 5,127,515 | * | 7/1992 | Damkjaer | 198/831 |
| 5,201,269 | * | 4/1993 | Eckert | 101/228 |
| 5,211,280 | * | 5/1993 | Houde | 198/836.3 |
| 5,263,414 | | 11/1993 | Lehrieder et al. . | |
| 5,396,982 | * | 3/1995 | Wicha | 198/494 |
| 5,768,998 | | 6/1998 | Enderlein et al. | 104/103 |

FOREIGN PATENT DOCUMENTS

| | | |
|---|---|---|
| 2856638 A1 | 8/1980 | (DE) . |
| 4202713 A1 | 8/1993 | (DE) . |
| 4202713 C2 | 11/1993 | (DE) . |
| 4411493 C1 | 8/1995 | (DE) . |
| 9408513 U1 | 11/1995 | (DE) . |
| 29516558 U1 | 1/1996 | (DE) . |
| 892208 | 3/1962 | (GB) . |
| 2125758 A | 3/1984 | (GB) . |
| 2161442 A | 6/1984 | (GB) . |

* cited by examiner

*Primary Examiner*—S. Joseph Morano
*Assistant Examiner*—Lars A. Olson
(74) *Attorney, Agent, or Firm*—Jones, Tullar & Cooper PC

(57) ABSTRACT

A length-variable sliding rail element enables a roller chain to be easily guided. Two complementary sliding rail elements fit together. Each of the sliding elements may be comprised of two or three segments. These various segments interengage each other to form a sliding rail element that is shiftable between collapsed and extended position.

7 Claims, 2 Drawing Sheets

LENGTH-VARIABLE SLIDING RAIL ELEMENT FOR A ROLLER CHAIN

FIELD OF THE INVENTION

The present invention relates to a length-variable guide rail element for a roller chain. The guide rail element is formed by two partial elements which can be displaced relative to each other and which have complementarily meshing segments.

DESCRIPTION OF THE PRIOR ART

A length-variable guide rail element, embodied C-shaped in profile, for use with a roller chain, in particular for a draw-in device, is known from DE 44 11 493 C1. The guide rail element consists of two partial guide rail elements, which can be pulled apart and which each have two diagonally opposite segments.

DE 42 02 713 C2 discloses a guide rail element having three segments, at one end of which, respectively viewed in cross section, a first segment is located opposite a second and third element on the other side of the roller. This guide rail element as a whole consists of five segments.

GB 2 125 758 A describes a section for a conveying device, which can be drawn apart. Here, two decks are arranged one above the other, wherein the respective lower running surface can be extended by means of a bracket.

GB 892 208 A describes a chain conveyor, wherein the chain links are length-variable and spatially movable.

SUMMARY OF THE INVENTION

The object of the present invention is based on providing a length-variable guide rail element.

In accordance with the present invention, is object is attained by providing a length variable guide rail element which has two partial elements. These two partial elements can be displaced relative to each other and have opposing segments. These segments are complementary in shape and mesh with each other. The two partial elements can be placed adjacent each other in a first position and can be drawn apart to a second position.

The advantages which can be obtained by means of the present invention rest, in particular, that a length-variable guide rail element is provided, which guides portions of a roller chain without problems. Thus, in a first preferred embodiment of a guide rail element, a roller chain can also be guided in an interlocked manner. Such a length-variable guided rail element can be used, for example, with a device, arranged on a lateral frame, for drawing in webs of material into web-fed rotary printing presses.

A length-variable guide rail element in accordance with a second preferred embodiment of the present invention also assures the problem-free guidance of a roller chain. This guide rail element is particularly suited for draw-in devices for wide webs of material, for example in connection with web-fed rotary rotogravure printing presses, wherein a roller chain is simultaneously guided in each of the two lateral frames, which are connected by means of struts over the clear width of the press. Length-variable guide rail elements can be employed in the same way in sheet-fed rotary printing presses, which respectively guide an endless roller chain for a so-called gripper carriage.

BRIEF DESCRIPTION OF THE DRAWINGS

Two preferred embodiments of the present invention are represented in the drawings and will be described in greater detail in what follows. Shown are in.

DESCRIPTION OF THE PREFERRED EMBODIMENTS

Figure 1:
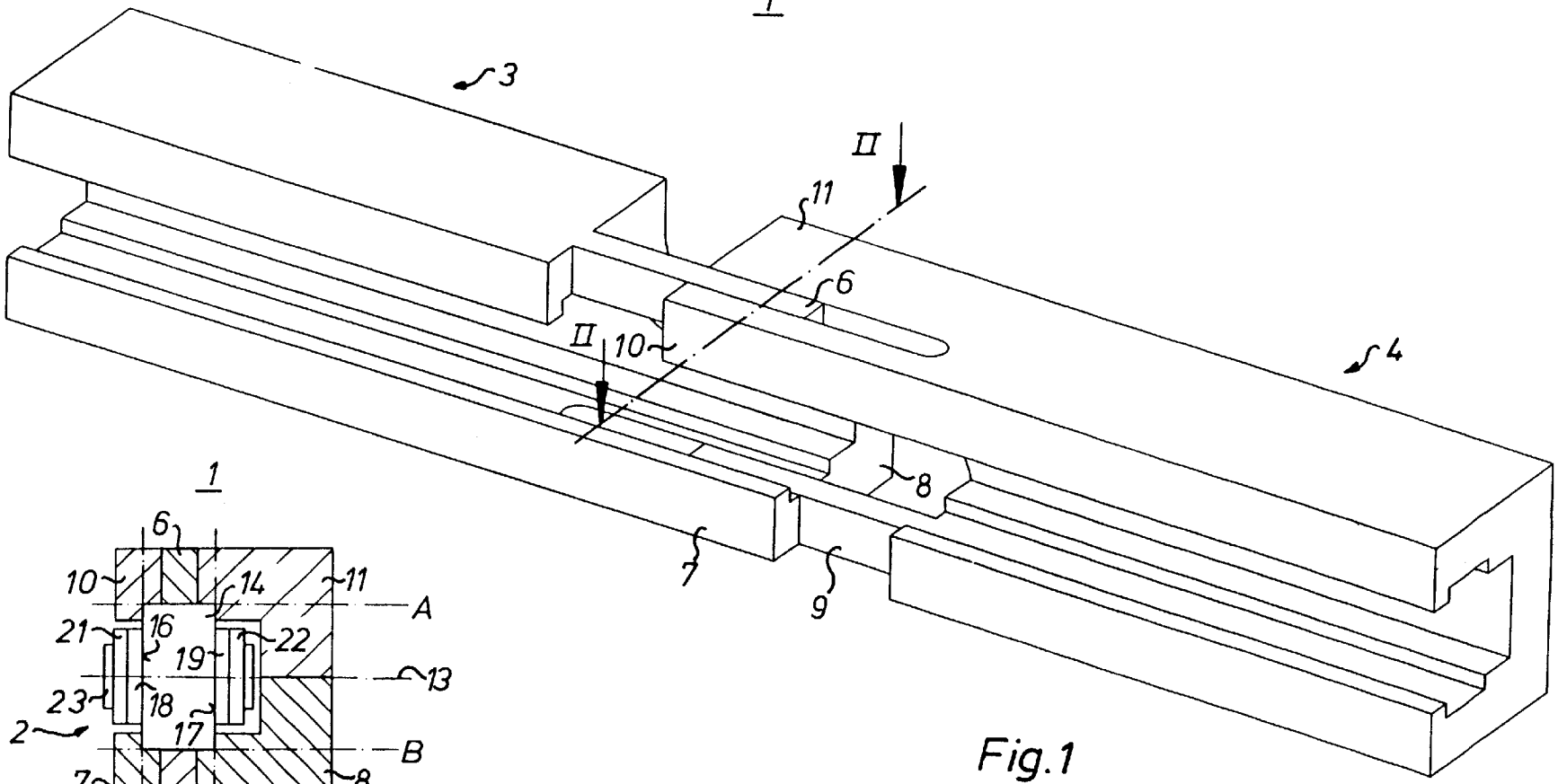
FIG. 1, a perspective representation of a length-variable guide rail element in accordance with a first preferred embodiment of the present invention.
Figure 2:
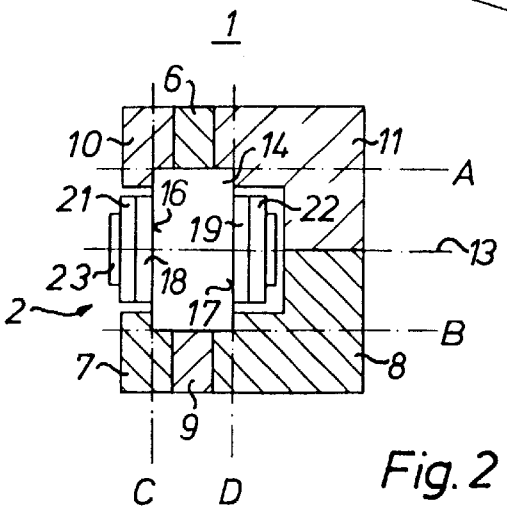
FIG. 2, a cross section taken along line II—II of FIG. 1, but with a representation of a cross section of a roller chain, FIG. 3, a perspective representation of a length-variable guide rail element in accordance with a second preferred embodiment of the present invention; and in FIG. 4, a cross section taken along line IV—IV of FIG. 3, but also with a representation of a cross section of a roller chain.

A first preferred embodiment of a length-variable guide rail element 1 has a C-profile in cross section for receiving a roller chain 2, and consists of two separate partial guide rail elements 3, 4, each of which has three segments 6, 7, 8; and 9, 10, 11, respectively which are located opposite each other and which mesh in a complementary manner, all as may be seen in FIGS. 1 and 2.

Of the three segments 6, 7, 8, of the first partial guide rail element 3 or respectively the three segments 9, 10, 11, of the second partial guide rail element 4 a respectively first or tongue segment 6, 9 is located opposite a second or finger segment 7, and a third or body segment 8, or respectively 11, which finger and body segments 7, 8 or 10, 11 are respectively located on the other side of the roller 14 of roller chain 2 with respect to the tongue segment 6 or 9 of the partial guide rail element 3, 4.

The segments 6, 7, 8, or respectively 9, 10, 11, of the partial guide rail elements 3, 4 are alike, if each of their cross sections is turned by 180° around an axis of rotation 13 of the rollers 14 of the roller chain 2, as may be seen most clearly in FIG. 2.

If the rollers 14 of the roller chain 2 are guided, for example, in a channel in the guide rail element 1 and bordered by four planes A, B, C, D, which intersect each other at right angles, of which respectively two planes A, B, as well as two planes C, D, extend parallel with each other, and at least two planes A, B extend parallel, in respect to the axis of rotation 13 of the roller 14, the first or tongue segment 6 of the first partial guide rail element 3 rests against the first upper level A. Furthermore, the second or finger segment 7 of the first partial guide rail element 3 rests against the third, left, vertically extending plane C, and the third or body segment 8 rests against the fourth, right, vertically extending plane D. The second and third segments 7 and 8 also rest against or define the second, lower plane B.

The three segments 9 to 11 of the second partial guide rail element 4 rest against the roller 14 as follows: the first or tongue segment 9 rests against the second, horizontal lower plane B, the second segment 10 rests against the third, left, vertically extending plane C, the third segment 11 rests against the fourth, right, vertically extending plane D, the second and third segments 10 and 11 rest against the first upper horizontal plane A.

In the second, or drawn-apart position of the first embodiment of the length variable guide rail element, as seen in FIG. 1, the rollers 14 are guided either by the segments 6 to 8 of the first partial guide rail element 3, or by the segments 9 to 11 of the second partial guide rail element 4. Depending on the load on the roller chain 2, a running surface for the roller 14 can be located either in the plane B or in the plane A, or partially in both planes B, A.

The rollers 14 are connected with each other by means of inner or outer brackets 18, 19, or 21, 22, and chain bolts 23.

If a chain guide must be designed to be length-variable, a partial chain guide element 3 or 4 is fixed on the lateral frame. In that case, both partial chain guide elements 3 and 4 are advantageously arranged, fixed in place on the lateral frame, in a preselected drawn-apart state if, for example, large temperature variations have an effect on the length of the chain guide, for example in drying ovens.

However, it is also possible to seat, i.e. to fasten, both partial chain guide elements 3, 4 at least slidingly in the lateral frame.

Figure 3:
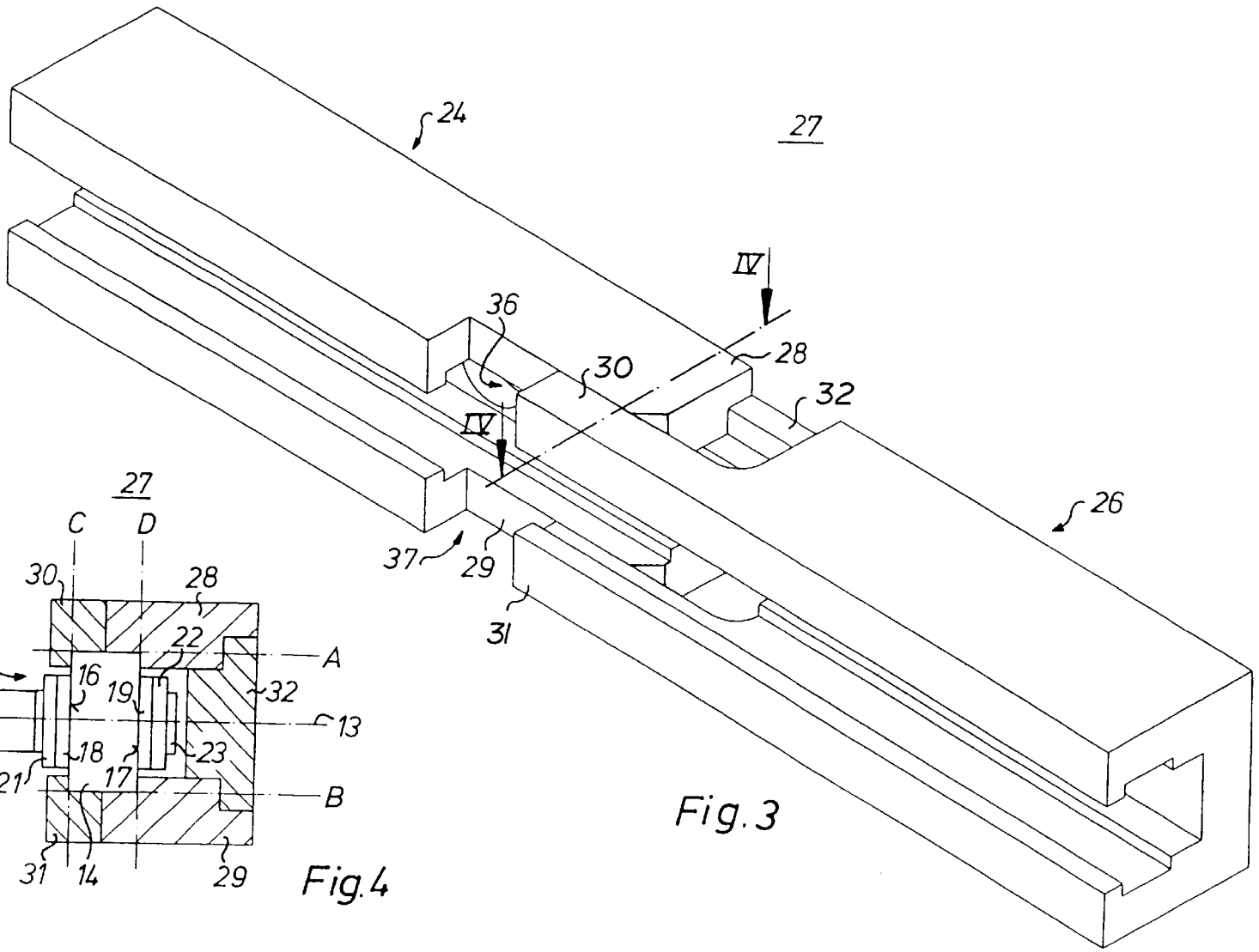
Figure 4:
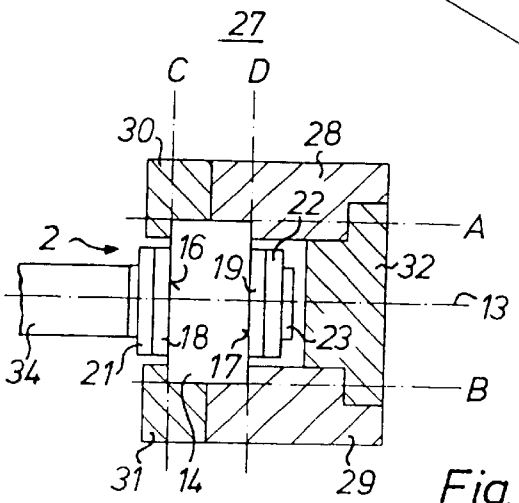

In accordance with a second preferred embodiment of the subject invention as shown in FIGS. 3 and 4, a guide rail element 27 consisting of two partial guide rail elements 24, 26, has a total of five segments 28 to 32. The first partial guide rail element 24 provides two segments 28, 29, and the second partial guide rail element 26 supports three segments 30, 31, 32, which five segments mesh in a complementary manner.

Viewed in cross section, as seen in FIG. 4, the two segments 28, 29 of the first partial guide rail element 24 are arranged above and below the roller 14, so that the first or upper body segment 28 rests against the first upper plane A and the second or lower body segment 29 against the second, lower plane B, and both segments 28, 29 together rest against the fourth, or right, vertical plane D.

Viewed in cross section, as seen in FIG. 4, the three segments 30, 31, 32 of the second partial guide rail element 26 are arranged in such a way that the first or upper finger segment 30 is arranged above and the second or lower finger segment 31 below the roller 14, and the third or intermediate finger segment 32 is arranged in the direction of the axis of rotation 13 of the rollers 14, next to the roller 14, as well as between the first and second or upper and lower body segments 28, 29 of the first partial, element 24. In this case, the first or upper finger segment 30 of the second partial guide rail element 26 rests against the first upper plane A, and the second or lower finger segment 31 against the second, lower plane B, and both segments 30, 31 rest together against the third, left, vertically extending plane C. The third or intermediate finger segment 32 of the second partial guide rail element is arranged complementary between the two segments 28, 29 of the first partial guide rail element.

Different chain bolts 23 of a roller chain 2 running in a first lateral frame can be connected by means of struts 34 as seen in FIG. 4 with similarly seated chain bolts of a second roller chain running in a second lateral frame, which is not specifically shown.

By means of this structure of chain bolts and struts it is possible to form a gripper carriage for sheet-fed rotary printing presses, or in case of web-fed rotary printing presses, to form a carriage extending over the entire width of the press for drawing in a particularly wide material web.

The first and second partial guide rail elements 24, 26 in accordance with the second preferred embodiment, as depicted in FIGS. 3 and 4, can be designed in such a modified way that the first or upper body segment 28 of the first partial guide rail element 24, as well as the first or upper finger segment 30 of the second partial guide rail element 26, each are of a greater length than the segments 29, 31, 32.

Alternatively to this, the segments 29, 31 of the first and second partial guide rail elements 24, 26 can have a different, for example greater length in respect to the the segments 28, 30, 32. Because of this, gaps 36, 37 are created in the second, drawn-apart position of the two partial elements 24, 26, which gaps are not located above each other, as represented in FIG. 3 but instead may be next to each other in an arrangement not represented in FIG. 4.

While preferred embodiments of a length-variable sliding rail element for a roller chain in accordance with the present invention, have been set forth fully and completely hereinabove, it will be apparent to one of skill in the art that a number of changes in, for example, the specific type of printing press being used with the rail elements, the drive for the roller chain, and the like could be made without departing from the true spirit and scope of the present invention which is accordingly to be limited only by the appended claims.

What is claimed is:

1. A length-variable guide rail for a roller chain comprising;

a first partial guide rail element;

a second partial guide rail element, said first and second partial guide rail elements being displaceable with respect to each other in a direction of travel of a roller chain guided by said length variable guide rail, and being complementarily meshing, said first partial guide rail element and said second partial guide rail element each forming a C-shaped guide rail element for guiding a roller chain having rollers;

a first tongue segment, a first finger segment, and a first body segment formed on a first end of said first partial guide rail element;

a second tongue segment, a second finger segment and a second body segment formed on a first end of said second partial guide rail element, said first tongue segment being received between said second finger segment and said second body segment, and said second tongue segment being received between said first finger segment and said first body segment when said first ends of said first and said second partial guide rail assemblies are complementarily meshing with each other; and four planes formed by said complementarily meshing first ends of said first and said second partial guide rail elements and defining a guide for the roller of a roller chain, a cross-section of said first partial guide rail element being equal to a cross-section of said second partial guide rail element rotated 180° about an axis of rotation of the rollers of the roller chain.

2. The length-variable guide rail element of claim 1 wherein said first tongue segment engages a first upper plane of said four planes, wherein said first finger segment engages a third vertically extending plane of said four planes, wherein said first body segment engages a fourth vertically extending plane of said four planes, and wherein said first finger segment and said first body segment engage a second lower plane of said four planes.

3. The length-variable guide rail element of claim 1 wherein said second tongue segment engages a second lower plane of said four planes, wherein said second finger segment engages a third vertically extending plane of said four planes, wherein said second body segment engages a fourth vertically extending plane of said four planes, and wherein said second finger segment and said second body segment engage a second upper plane of said four planes.

4. A length-variable guide rail for a roller chain comprising;

a first partial guide rail element;

a second partial guide rail element, said first and second partial guide rail elements being displaceable with respect to each other in a direction of travel of a roller chain guided by said length variable guide rail and being complementarily meshing, said first partial guide rail element and said second partial guide rail element each forming a C-shaped guide rail element for guiding a roller chain having rollers;

an upper body segment and a lower body segment on a first end of said first partial guide rail element, said upper body segment being disposed above a roller of a roller chain, and said lower body segment being disposed below a roller of a roller chain;

an upper finger segment, a lower finger segment, and an intermediate finger segment on a first end of said second partial guide rail element, said upper finger segment being disposed adjacent said upper body segment and above the roller, said lower finger segment being disposed adjacent said lower body segment and below the roller, and said intermediate finger segment being disposed intermediate said upper body segment and said lower body segment and spaced in an axial direction of an axis of rotation of the roller when said first ends of said first and said second partial guide rail elements are complementarily meshing with each other; and four planes formed by said complementarily meshing first ends of said first and said second partial guide rail elements and defining a guide for the rollers of the roller chain, said upper body segment and said lower body segment both engaging a vertical one of said four planes.

5. The length-variable guide rail element of claim 4 wherein said upper body segments engages an upper plane of said planes, and wherein said lower body segment engages a lower plane of said planes.

6. The length-variable guide rail element of claim 4 wherein said upper finger segment engages an upper plane of said planes, wherein said lower finger segment engages a lower plane of said planes, wherein both said upper and lower finger segments engage a first, vertical plane of said planes, and wherein said intermediate finger segment engages said upper and lower body segments.

7. The length-variable guide rail element of claim 4 wherein said upper body segment and said upper finger segment have a first length, and wherein said lower finger segment, said intermediate finger segment, and said lower body segment have a second length, and wherein said first and said second lengths have different values.

* * * * *